United States Patent [19]

Johnson

[11] Patent Number: 4,757,946

[45] Date of Patent: Jul. 19, 1988

[54] FLOW ACTUATED PULSATOR

[76] Inventor: Lonnie G. Johnson, 1463 E. Barkley Dr., Mobile, Ala. 36606

[21] Appl. No.: 806,593

[22] Filed: Dec. 9, 1985

[51] Int. Cl.[4] ..... B05B 3/04

[52] U.S. Cl. ..... 239/99; 239/381; 239/211; 446/130; 446/418; 446/473; 116/2

[58] Field of Search ..... 239/525, 380–383, 239/389, 102.1, 101, 570, 583, 97, 211; 222/79, 383; 446/130, 180, 418, 473; 137/624.14; 116/274, 2, 155, 204

[56] References Cited

U.S. PATENT DOCUMENTS

| | | | |
|---|---|---|---|
| 1,855,647 | 4/1932 | Pottenger | 137/624.14 X |
| 3,163,330 | 12/1964 | Ryan | 222/383 X |
| 3,365,838 | 1/1968 | Butler et al. | 222/79 X |
| 3,512,543 | 5/1970 | Kubik | 137/624.14 X |
| 3,747,858 | 7/1973 | Krynicki | 239/101 X |
| 4,461,319 | 7/1984 | Macosko | 137/624.14 X |
| 4,534,510 | 8/1985 | Rinkewich | 239/240 X |
| 4,591,071 | 5/1986 | Johnson | 222/39 |

FOREIGN PATENT DOCUMENTS

| | | | |
|---|---|---|---|
| 144295 | 2/1949 | Australia | 116/274 |
| 394106 | 12/1973 | U.S.S.R. | 239/101 |

*Primary Examiner*—Andres Kashnikow
*Assistant Examiner*—Kevin P. Weldon
*Attorney, Agent, or Firm*—Zarley, McKee, Thomte, Voorhees & Sease

[57] ABSTRACT

A flow actuated pulsator for shooting water in consecutive pulses. The pulsator is powered by water flowing under pressure therethrough and includes a nozzle for ejecting water at high speed, a pulse valve which cycles through opened and closed states to effect on-off cycling of water flow and a sound effects generator for producing sound effects with each water pulse. The pulse valve is biased to an open state when the pulsator is not being actuated by flowing water so that an initial water flow initiates open-closed cycling. The pulse valve is biased to an open state following each closed cycle. The pulsator is built into a compressed air powered water gun designed to contain water and air under pressure and including an air pump for compressing air into the gun to pressurize water contained therein and a trigger coupled to a valve for manually shooting the gun by controlling flow of pressurized water to the pulsator.

21 Claims, 2 Drawing Sheets

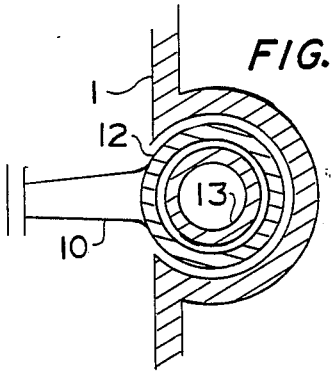
FIG. 3
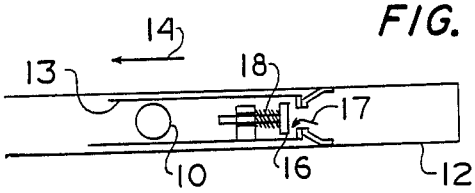
FIG. 4
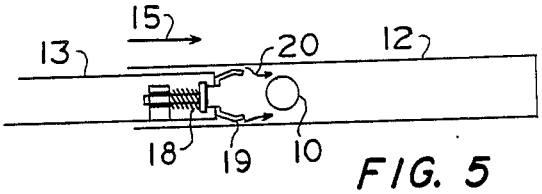
FIG. 5
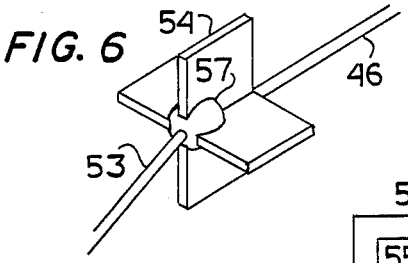
FIG. 6
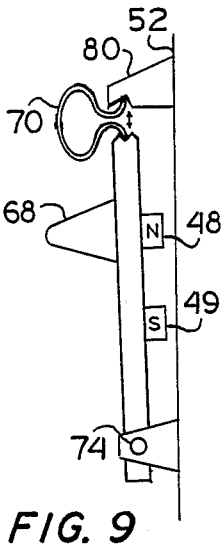
FIG. 9
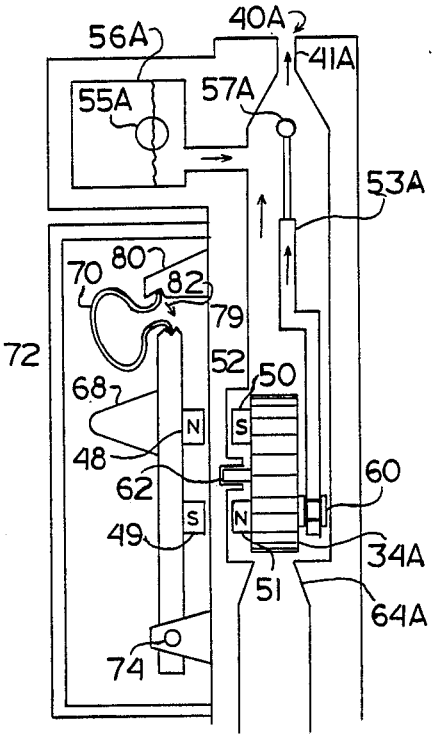
FIG. 7
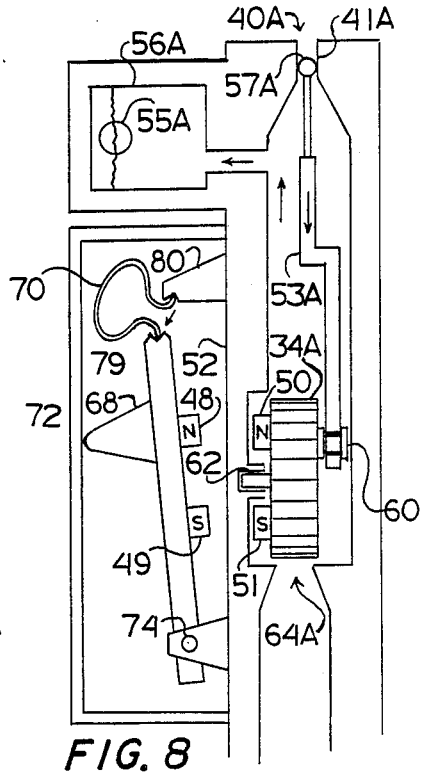
FIG. 8
FIG. 10
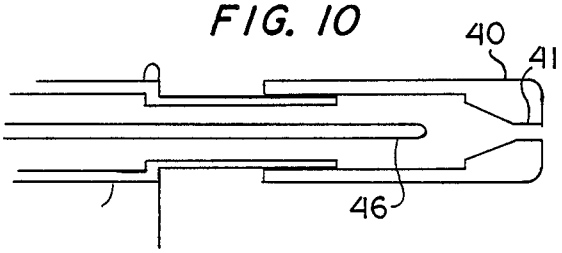
FIG. 11
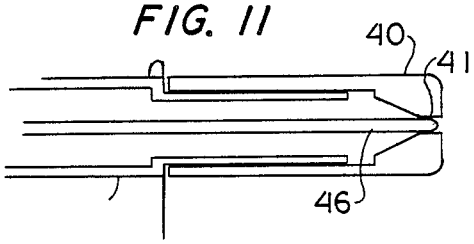

FLOW ACTUATED PULSATOR

BACKGROUND AND SUMMARY

The present invention controls the flow of pressurized water from a source to produce consecutive rapid sequence water pulses. The disclosure includes adaptation to a toy water gun which operates on compressed gas. The pulsator mechanism includes a sound generator to produce clacking sound effects when the gun is shooting. The pulsator is powered by pressurized water flow so as to eliminate the need for any power source other than the compressed gas.

Patent application Ser. No. 06/541,898 for a Squirt Gun by the present inventor, Lonnie G. Johnson, discloses a hand-held toy squirt gun which operates on compressed air, has a futuristic space ray gun appearance and includes sound effects. The application included a manually actuated air pump physically mounted underneath the gun barrel for pressurizing the gun. It included a water flow actuated sound generator for producing audiable sound effects when the gun is shooting and a battery-powered electronic oscillator circuit for producing sound effects as well.

The present invention causes water to be ejected from a gun in pulses and discloses an improved sound generator. The sound generator includes a mallet which repeatedly impacts a diaphram to produce machine gun sound effects in synchronization with pulsating water flow. The invention also discloses use of a relatively large diameter conduit for pressurized water flow internal to the gun and a relatively large nozzle bore diameter. These features are important for minimizing head loss at high flow rates. Minimized head loss along with the large water stream permitted by the nozzle enables the gun to shoot a relatively long distance. The water stream produces a slight recoil sensation with each water pulse. The invention is disclosed embodied as a modern machine gun in appearance to take advantage of the machine gun (clacking) sound and pulsating water effects. It includes adaption of the air pump to a machine gun cocking lever type action for compressing air into the gun.

BRIEF DESCRIPTION OF THE DRAWINGS

FIG. 3 shows concentric cylinder mounting of a pump along one side of the gun's structure for a cocking lever type pumping action.

FIG. 4 shows actuation of the pump in the compressive stroke.

FIG. 5 shows actuation of the pump to resupply air into the pump cylinder.

FIG. 6 shows an enlarged view of the ball joint located in the pulsator used in linking the pulsator rod to the impeller.

FIG. 7 shows operation of the pulsator, sound generator and damper in a configuration which permits water flow.

FIG. 8 shows operation of the pulsator, sound generator and damper in a configuration which inhibits water flow.

FIG. 9 shows operation of the sound generator with the sound generator spring under maximum compression.

FIG. 10 shows the adjustable nozzle in the forward position which permits continuous non-pulsating water flow.

FIG. 11 shows the adjustable nozzle in the aft position which allows movement of the pulsator rod in and out of the nozzle's throat to effect pulsating water flow.

DETAILED DESCRIPTION AND PREFERRED EMBODIMENT

Figure 1:
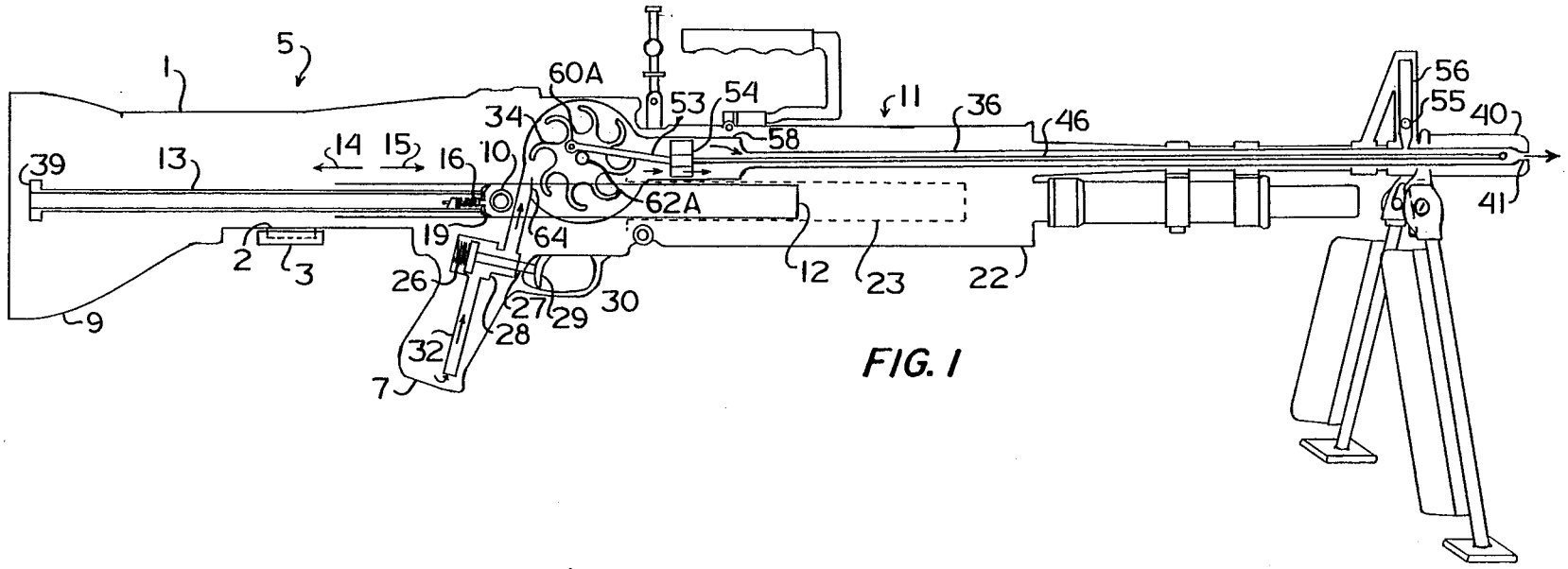
FIG. 1 is a functional diagram showing features of a squirt gun incorporating the invention.
Figure 2:
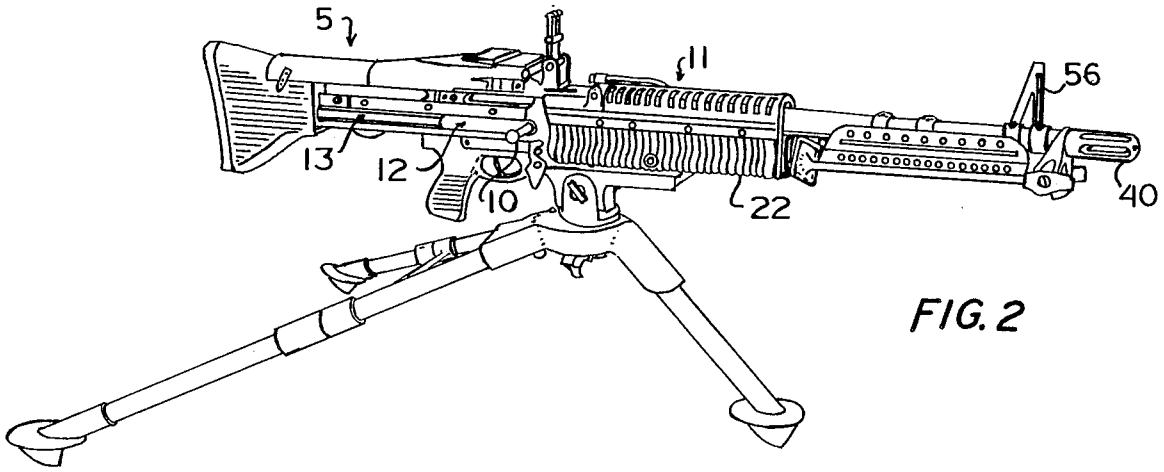
FIG. 2 shows embodiment of the invention as a M-60 machine gun.

An in-depth understanding of the present invention can be derived from the following description with reference to the drawings. FIG. 1 is a configuration drawing showing the major features of a water gun. Water gun structure means 1 is designed to contain water and air under internal pressure. Structure means 1 also provides mounting support for various elements of the gun. A water fill port comprised of port 2 and screw-on cap 3 functions as a fill port for opening structure 1 to put water in the gun and resealing it so as to not permit leakage when the gun is pressurized.

Grip handle means 7 and butt section 9 are integral parts of structure 1 and serve an additional function of preventing the gun from being completely filled with water. When the gun is held up side down with the fill port open, grip 7 and but section 9 are above the maximum water level determined by the position of fill port 2. The air retained in grip 7 and butt section 9 under this condition insures there will always be a void of water inside the gun into which air can be compressed. Conversely, when the gun is held up right, grip 7 is at the bottom and therefore will contain water when ever water is present in the gun. The only exception is water which may be contained in butt section 9 which can easily be removed by pointing the gun down and allowing it to flow to grip 7.

A manually operated pressurization pump means comprised of pressurization piston means 13, check valve means 16, seal 19 and a moveable member means comprised of cocking lever means 10 and pressurization cylinder means 12 functions to compress air into structure 1. Cocking lever 10 is fixed to cylinder 12 and extends from the side of structure 1 so as to facilitate manual actuation of the air pump in a machine gun cocking lever type action. Pump cylinder 12 is moveably coupled by concentric cylinder mounting in a grove along the side of structure 1 to permit sliding length wise along butt assembly 5 and forearm assembly 11. The concentric cylinder mounting is shown in a cross sectional view in FIG. 3. Piston 13 is an integral part of structure 1 and provides additional internal volume for containing air and water. It is attached at rear location 39 of butt assembly 5 so as to leave its front end free to extend in to cylinder 12. Compressed air is pumped into structure means 1 by moving lever 10 and thereby cylinder 12 back and forth along the side of the butt assembly in a cocking type action as indicated by arrows 14 and 15. The compressive stroke is in the direction of arrow 14 as shown in FIG. 4. As cylinder 12 is moved further onto piston 13, the pressure inside cylinder 12 increases and opens check valve 16. The compressed air flows into structure 1 as illustrated by arrow 17. Check valve 16 is normally held closely by spring 18. The refill stroke is shown in FIG. 5. As cylinder 12 is moved in the direction of arrow 15, piston 13 is withdrawn and ambient air is sucked in past seal 19 as depicted by arrows 20. The gun is pressurized by repeating this cycle with back and forth motion of cocking lever 10. Forearm grip 22 is configured as a cover which in combination with the remaining structure of forearm assembly 11 provides internal space 23 to permit free movement of cylinder 12. This feature allows the gun to be confiured as a modern M-60 machine gun in appearance. The maximum pressure reached inside the water gun is determined by the ratio of the maximum volume to minimum volume created inside pump cylinder 12. The maximum pressure could also be controlled by including a pressure relief valve.

As shown in FIG. 1, to shoot the water gun, control valve means 28 is opened by pressing trigger means 29 in the direction of arrow 30. Control valve 28 is mounted to structure means 1 and includes moveable shaft means 27 which extends external to structure 1. Trigger 29 is attached to shaft 27. With valve 28 open, pressurized water flows into conduit means 32 and up through valve 28 from the bottom of the gun as the compressed air in the top part expands. Pressurized water exiting valve 28 impinges impeller means 34 causing impeller 34 to rotate as pressurized water flows through and on into conduit means 36. The pressurized water flows through conduit 36 to nozzle means 40 where it is ejected at high velocity.

Impeller 34 is a prt of a pulsator means which functions to repeatedly interupt the water flow when the gun is shooting causing the flow to pulsate creating a rapid fire effect. In addition to the pulse flow responsive means represented by impeller 34, the pulsator includes a pulse valve means represented by plunger means 46, link means 53 and nozzle throat means 41, a bias means represented by first magnetic means 48 and 49 and second magnetic means 50 and 51, (shown in FIGS. 7 and 8) and a damper means represented by air reservoir 56. Reservoir 56 is configured as a gun sight. Plunger rod 46 is positioned inside conduit 36 and extends the entire length. It is coupled to impeller 34 by link 53. Link 53 is connected to impeller 34 at off axis pivot joint 60A such that as impeller 34 rotated about axis 62A, rod 46 is caused to move in a back and forth motion. This motion causes rod 46 to periodically block water flow by moving in and out of nozzle throat 41. The water hammer effect produced by abruptly stopping the column of water flowing through conduit 32, impeller 34 and conduit 36 toward nozzle 40 with each pulse is absorbed by damper 56. Damper 56 contains a reservoir of air which is compressed due to momentum of the flowing water column moving toward the front of the gun each time the flow is blocked at the nozzle. Each time the nozzle is opened, the air in damper 56 expands forcing water accumulated in the damper out through nozzle 40. By operating in this manner, damper 56 absorbes the energy of the moving water column when the flow is blocked and releases this energy helping to accelerate water through the nozzle each time the nozzle is opened. Water flowing into damper 56 when the nozzle is closed results in a low level flow through impeller 34 which helps to maintain its rotation and thereby return nozzle 40 to an open state. Float 55 provides a visible indication of the water level in damper 56. Float 55 moves up and down with each open-closed cycle of nozzle 40. It is configured having a bright red or florescent color and is visible only when the up position so that, when operating, it creates a muzzle flash sensation with each water pulse.

Flaired end 54 of pulunger rod 46 is mounted in enlarged section 58 of conduit 36 and configured such that motion of the flaired section is restricted to a horizontal direction. An enlarged view of end 54 is shown in FIG. 6. Link 53 is connected to end 54 in a ball and socket type joint. Ball means 57 is restricted to horizontal displacement while permitting free angular motion of link 53 with cyclic operation of impeller 34. End 54 is a finned structure which allows free passage of water flowing toward nozzle 40. Having rod 46 extend the length of conduit 36 allows the convenience of locating impeller 34 a significant distance away from nozzle 40. This feature allows the M-60 appearance to be maintained while avoiding the addition of a throat near the impeller which would increase head loss and adversely impact the distance the gun shoots.

A bias means functions to maintain the nozzle in an open state under conditions of no water flow so that water flow is permitted to initialize rotation of impeller 34 when valve 28 is opened to shoot the gun. FIGS. 7 and 8 show a simplified nozzle and plunger configuration and conveys operation of the bias means. The conduit coupling flow from the impeller to the nozzle is shortened significantly. Link 53A extends directly into nozzle throat 41A and functions as the plunger means. As impeller 34A rotates and moves link 53A, it causes ball 57A to move in and out of nozzle throat 41A. Ball 57A allows link 53A to change angles freely with rotation impeller 34A. The orientation of first magnetic means 48 and 49 is fixed. Second magnetic means 50 and 51 are mounted to impeller 34A. Magnets 48, 49, 50 and 51 comprise a bias means and are configured such that the mutual attraction of opposite poles bias impeller 34A to a preferred orientation such that ball 57A is removed from nozzle throat 41A as shown in FIG. 7. When water flows from nozzle 64A through impeller 34A, the flow rotates the impeller moving ball 57A into nozzle 40A blocking flow through the nozzle and ending the first water pulse as depicted in FIG. 8. Impeller 34A continues to rotate because of its accumulated momentum, residual flow through nozzle 64A because of water flow into damper 52A as air contained therein is compressed, and the repelling of like poles of magnets 48, 49, 50 and 51. As rotation continues, ball 57A is removed from throat 41A. This allows water to once again flow through throat 41A beginning another water pulse. The cycle continues until the trigger is released stopping the water flow.

Machine gun sound effects are produced by a flow actuated sound generator means which includes mallet means 68, spring means 70, diaphram means 72 and a coupling means represented by baffle or wall means 52 and magnetic means 48, 49, 50 and 51. Mallet 68 is mounted to pivot joint 74. First magnetic means 48 and 49 are mounted to mallet 68. As previously described, second magnetic means 50 and 51 are mounted to impeller 34A. They comprise a coupling means for operably linking the sound generating mechanism to the sound flow responsive means represented by impeller 34. Impeller 34 extracts operating power for the sound generator from the water flowing therethrough. Both the sound flow responsive means and the pulse flow responsive means are represented by impeller 34. They are one and the same. The bias means for the pulsator and the coupling means for the sound generator are both represented by magnetic means 48, 49, 50 and 51 and therefore are one and the same. As impeller 34 rotates opposite and like poles of magnets 48, 49 59 and 51 are alternatingly aligned causing mallet 68 to be sequentially attracted and repelled resulting in a back and forth oscillating motion about pivot joint 74. This motion causes mallet 68 to repeatedly strike diaphram 72 in synchronization with water pulses being expelled from nozzle 40A.

Operation of the sound generator is enhanced by spring 70. Referring to FIG. 7, spring 70 is mounted between free end 79 and bracket 80 under compression. When impeller 34 has rotated to a position wherein opposite poles are aligned, mallet 68 is attracted to its forward position. Spring 70 pushes forward on mallet 68 as indicated by arrow 82. As the impeller continues to rotate, alignment of like poles is approached and mallet 68 is pushed back as depicted in FIG. 9 compressing spring 70 to its maximum compression point. Continued rotation of impeller 34 pushes mallet 68 pass the maximum compression point. Spring 70 re-expands and helps continue the backward motion of mallet 68 in a snap action causing mallet 68 to impact diaphram 72 at high velocity and produce sound illustrated in FIG. 8. As the impeller rotates toward allignment of opposite poles, mallet 68 is pulled forward and spring 70 functions to produce a snap action in the forward direction. The cycle is continued as impeller 34 continues to rotate. Diaphram 72 is configured as a protective cover enclosing the moving components of the sound producing mechanism. The sound producing mechanism is isolated from the pressurized water within structure 1 to allow efficient coupling of the sound vibrations it produces to the ambient air surrounding the gun. The magnetic coupling allows relatively low torques produced by impeller 34 to be efficiently coupled to mallet 68 with out friction losses associated with a pressure seal around a shaft. There is no hole through wall 52 of structure 1 which could cause loss of pressure. Wall 52 functions as a baffle means which prevents leakage of pressurized water to the exterior of the gun as the water flows through impeller 34.

As illustrated in FIGS. 10 and 11, nozzle 40 is adjustable to aft and forward positions to select pulsating or continuous water flow respectively. When in the aft position shown in FIG. 10, operation of the pulsator is as described above. Plunger rod 46 cycles in and out of throat 41. However, when nozzle 40 is manually positioned to the forward position as shown in FIG. 10, continuous, non-pulsating water flow is effected. Plunger 46 is precluded from extending into throat 41 as it cycles back and forth with rotation of impeller 34.

Although the present disclosure specifically includes embodiment of the invention as a M-60 machine gun in appearance, this is not intended to restrict the invention to this application. The invention could also be embodied as other military guns, M-16, UZI, AK47, etc. or as a futuristic space gun. Infact, an electronic sound generator similar to that disclosed in the referenced application could be included in order to provide added flexibility in producing sound effects. In addition, as disclosed in the referenced application, the pressurization pump could be mounted along the gun barrel for a pump shot gun type action as an alternative to the machine gun cocking lever type action. Use of fluids other than water is possible. This is particularly true for pulsator applications other than for toy guns.

What is claimed is:

1. A squirt gun for shooting a pulsating stream of water, said squirt gun comprising in combination a structure means for containing water and air under pressure, a pressurization pump means for compressing air into said structure means to pressurize water contained therein, a trigger means and a flow control valve means for facilitating manual control of shooting of said gun, a nozzle means for increasing the velocity of said water pulses as said water pulses are ejected from said gun when said gun is shooting, a flow actuated pulsator for controlling flow of pressurized water to said nozzle means when said gun is shooting and causing said water to flow in a pulsating manner and thereby causing said gun to shoot water pulses and a conduit means for fluidically coupling said nozzle means to said pulsator means, said control valve means being fluidically coupled to said pulsator means and controlling flow of pressurized water thereto, said pulsator means being mechanically actuated by water therethrough when said gun is shooting, said pulsator inturn controlling flow of water therethrough to said nozzle means.

2. A squirt gun as disclosed in claim 1 wherein said pulsator comprises a pulse valve means for operating in a cyclic manner between opened and closed states to permit and inhibit water flow, a pulse flow responsive means for deriving operating power from water flowing through said pulsator and actuating said pulse valve means to effect open and closed states thereof, and a bias means for returning said pulse valve means to an open state to re-establish water flow whenever flow at said pulse valve means has been terminated, said pulse flow responsive means, said bias means and said pulse valve means being configured in combination such that water flowing through said pulsator actuates said pulse flow responsive means which in turn operates with said bias means to continuously open and close said pulse valve means causing said water flow to be periodic.

3. A squirt gun as disclosed in claim 2 wherein said squirt gun further includes a flow actuated sound generator means for producing audible sound effects, said sound generator including a sound flow responsive means for extracting operating power from flowing water, a mallet means and a diaphram means for producing sound, and a coupling means for operably coupling said sound flow responsive means to said mallet means to facilitate actuation of said mallet means by said sound flow responsive means, pressurized water flowing through said sound flow responsive means causing movement thereof and thereby actuation of said mallet means, said sound flow responsive means operating in a cyclic manner alternatingly causing said mallet means to move back and forth striking said diaphram means in the process and producing audible sound.

4. A squirt gun as disclosed in claim 3 wherein the path of water flow from said structure means to said nozzle means including said control valve means, said sound generator means, said pulsator means and said conduit means is configured for minimum head loss and said nozzle means is configured having a large bore diameter, said minimized head loss in combination with a large water stream permitted by said nozzle enabling said squirt gun to shoot a long distance.

5. A squirt gun as disclosed in claim 4 wherein said pressurization pump means includes a moveable member means, said moveable member means being moveably coupled to said structure means along at least one side thereof and including a cocking lever means extending therefrom for facilitating manual actuation of said pressurization pump means, said cocking lever means and thereby said moveable member means being manually actuatable to effect pumping of air into said structure means, said pressurization pump means comprising in combination a pressurization cylinder means and a pressurization piston means, said pressurization piston means being configured to extend into said pressurization cylinder means such that back and forth motion of said moveable member means along said structure means in a cocking lever type action moves said piston means in and out of said cylinder means to effect pumping of air into said structure means.

6. A squirt gun as disclosed in claim 5 wherein said moveable member means includes said pressurization cylinder means, said moveable member means being configured such that said cocking lever means is fixed to said pressurization cylinder means for facilitating movement of said pressurization cylinder means back and forth along at least one side of said structure means in a machine gun cocking lever type action, said pressurization piston means comprising an integral part of said structure means and being configured such that it extends into said pressurization cylinder means, actuation of said cocking lever effecting one way flow of compressed air into said structure means from said pressurization cylinder means, compressed air displaced from said cylinder being replaced by ambient air out side the cylinder with each return stroke of said pressurization cylinder means.

7. A squirt gun as disclosed in claim 6 wherein said pressurization pump means is mounted in a concentric cylindrical cavity along one side of said structure means, said cylindrical cavity including a slot configured lengthwise along said cylindrical cavity, said cocking lever extending outward from said slot to an extent sufficient to permit manual movement of said cocking lever to effect pumping.

8. A squirt gun as disclosed in claim 7 wherein said squirt gun is configured as a contemporary military machine gun in appearance.

9. A squirt gun as disclosed in claim 8 wherein said squirt gun resembles a M-60 machine gun.

10. A water pulsator as disclosed in any one of claims 8 and 9 wherein said pulse valve means comprises a throat means and a plunger means, said plunger means being coupled to said pulse flow responsive means and being configured to move in and out of said throat means, said throat means functioning as a passage for water flow when said plunger means is removed therefrom and being blocked to prevent water flow when said plunger means extends therein, said pulse flow responsive means operating in a cyclic manner to continuously move said plunger means in and out of said throat means to alternatingly permit and inhibit water flow, said pulse flow responsive means accumulating momentum, when actuated by water flow and thereby maintaining cyclic operation of said pulse flow responsive means when water flow has been inhibited at said pulse valve means and thereby aiding said bias means in moving said plunger out of said throat means to reestablish water flow.

11. A pulsator as disclosed in claim 10 wherein said pulsator means included an adjustment means for controlling pulsating of said pulsating means, said adjustment means having at least two manually selectable positions wherein one position effects pulsating water flow and a second position effects continuous non-pulsating flow, said adjustment means comprising said throat means, said throat means being positionable to at least two positions wherein one position is such that said plunger means cycles in and out of said throat means to effect pulsating water flow and a second position precludes movement of said plunger means into said throat means and thereby effects continuous non-pulsating water flow.

12. A pulsator as disclosed in claim 11 wherein said plunger means comprises a plunger link means and a ball means, said ball means being fixed to said link means, said link means being coupled to said pulse flow responsive means, said pulse flow responsive means operating to effect cyclic motion of said link means and thereby effect movement of said ball means, said ball means being restricted to back and forth linear motion while allowing angular motion of said link means, said back and forth linear motion of said ball means effecting periodic blockage of said throat means causing water flow through said throat means to be periodically inhibited.

13. A pulsator as disclosed in claim 12 wherein said throat means comprises said nozzle means and said plunger means further comprises a plunger rod means, said plunger rod means being connected to said ball means and extending through said conduit means to said nozzle means and being configured to move in and out of said nozzle means, motion of said plunger rod means being restricted to linear movement along said conduit means, water flow through said nozzle means being permitted when said plunger rod means is removed therefrom and being blocked when said plunger rod means extends therein.

14. A sound generator means as disclosed in claim 13 wherein said coupling means comprises a first and a second magnetic means for operably coupling said flow responsive means to said mallet means and facilitating actuation of said mallet means by said flow responsive means, said coupling means further comprising a wall means for maintaining containment of water flowing through said sound flow responsive means so as to not permit leakage, said first magnetic means being mated to said flow responsive means and said second magnetic means being mated to said mallet means, said wall means being physically positioned between said first and second magnetic means, said first and second magnetic means exerting magnetic force across said wall means and thereby operably coupling said flow responsive means and said mallet means, pressurized water flowing through said flow responsive means causing movement thereof and thereby movement of said first magnetic means, said second magnetic means moving in turn due to magnetic coupling to said first magnetic means and thereby actuating said mallet means, said flow responsive means operating in a cyclic manner to alternatingly align like and unlike poles of said first and second magnetic means causing said mallet means to move alternatingly back and forth toward and away from said flow responsive means and strike said diaphragm means in the process to produce audible sound.

15. A flow actuated sound generator as disclosed in claim 14 wherein said sound generator includes a spring means coupled to said mallet means to enhance the operation of said sound generator by causing said back and forth movement of said mallet means to occur in a snapping action resulting in higher velocity impacts of said mallet means on said diaphram means.

16. A pulsator as disclosed in claim 15 wherein said pulsator includes a water hammer damper means for reducing structural stresses which could otherwise be caused by the sudden interuptions of water flow during operation of said pulsator, the momentum of water flowing toward said pulse valve means during periods when said pulse valve means is open causing accumulation of potential energy in said damper means each time said pulse valve means cycles through a closed state, said damper means releasing said potential energy each time said pulse valve means cycles through an open state, water flow into said damper means resulting in a residual flow through said flow responsive means during closed states of said pulse valve means, said residual flow in combination with said momentum of said pulse flow responsive means and said bias means returning said pulse valve means to an open state to re-establish water flow each time flow is interupted by the pulsator.

17. A water hammer damper means as disclosed in claim 16 wherein said damper means comprises as air reservoir wherein air is compressed to store potential energy each time said pulse valve means cycles through a closed state and re-expands to release said potential energy each time said pulse valve opens, said reservoir means including a float means for enhancing the visual indication of the water level contained in said reservoir means, said float means cycling up and down with each water pulse released by said pulsator means to provide a visual effect when said gun is shooting.

18. A pulsator as disclosed in claim 17 wherein said pulse flow responsive means and said sound flow responsive means comprise a single impeller means and said pulsating water flow through said pulsator means is in synchronization with said sound produced by said sound generator means.

19. A pulsator as disclosed in claim 18 wherein said bias means comprises a magnetic bias means.

20. A sound generator means as disclosed in claim 19 wherein said coupling means comprises said magnetic bias means.

21. A water pulsator for controlling the flow of water from a source and causing said water to flow as a sequence of pulses, said pulsator including in combination a pulse valve means for operating in a cyclic manner between opened and closed states to permit and inhibit water flow and a pulse flow responsive means for deriving operating power from water flowing through said pulsator and actuating said pulse valve means to effect open and closed states thereof, said pulsator further including a bias means for returning said pulse valve means to an open state to permit water flow whenever flow has been terminated, said pulse flow responsive means, said bias means and said pulse valve means being configured in combination such that water flowing through the pulsator actuates said pulse flow responsive means which in turn operates with said bias means to continuously open and close said pulse valve means causing said water flow to be periodic, said pulsator including in combination a nozzle means and a conduit means, said nozzle means functioning to increase the velocity of water pulses flowing from said pulsator and ejecting said water pulses at high velocity, said conduit means conducting water flow to said nozzle means, said pulsator further including a flow actuated sound generator means for producing audible sound effects, said sound generator including a sound flow responsive means for extracting operating power from flowing water, a mallet means and a diaphram means for producing sound, and a coupling means for operably coupling said sound flow responsive means to said mallet means to facilitate actuation of said mallet means by said sound flow responsive means, pressurized water flowing through said sound flow responsive means causing movement thereof and thereby actuation of said mallet means, said sound flow responsive means operating in a cyclic manner alternatingly causing said mallet means to move back and forth striking said diaphram in the process and producing audible sound.

* * * * *